United States Patent [19]

Lau

[11] Patent Number: 4,908,544

[45] Date of Patent: Mar. 13, 1990

[54] STORAGE BIN MOUNTING SYSTEM FOR A REFRIGERATOR AND METHOD OF ASSEMBLY

[75] Inventor: Robert G. Lau, Evansville, Ind.

[73] Assignee: Whirlpool Corporation, Benton Harbor, Mich.

[21] Appl. No.: 227,920

[22] Filed: Aug. 3, 1988

[51] Int. Cl.[4] ..... A47F 3/00

[52] U.S. Cl. ..... 312/321.5

[58] Field of Search ..... 108/109; 211/88, 187, 211/191, 193; 248/239; 312/245, 247, 138 R, 214, 270, 298, 236, 306, 246, 321.5

[56] References Cited

U.S. PATENT DOCUMENTS

| | | | |
|---|---|---|---|
| 2,000,944 | 5/1935 | Gilbert et al. | 312/138 A |
| 3,057,483 | 10/1962 | Derman | 211/187 X |
| 3,237,779 | 3/1966 | Eger | 211/191 |
| 3,523,613 | 8/1970 | Konstant | 211/191 |
| 3,580,535 | 5/1971 | Naske | 248/239 |
| 3,807,822 | 4/1974 | Amore | 312/138 A |
| 4,779,939 | 10/1988 | Stich | 312/138 A X |

FOREIGN PATENT DOCUMENTS

| | | | |
|---|---|---|---|
| 851667 | 10/1960 | United Kingdom | 312/138 A |

*Primary Examiner*—Joseph Falk

*Attorney, Agent, or Firm*—Mason, Kolehmainen, Rathburn & Wyss

[57] ABSTRACT

A storage bin mounting system includes a pin and hook arrangement that prevents large bins from being mounted on certain areas of a refrigerator door to prevent interference with refrigerator members mounted in the refrigerator compartment opposite to those areas of the door. The system includes pairs of vertically aligned forwardly positioned pins with the pins of a pair extending inwardly from opposite door dikes. Vertically aligned rearwardly positioned pins are also provided, with the pins in a pair extending inwardly from opposite door dikes at a distance from the door's rear wall that is less than the distance between the forwardly positioned pins and the door's rear wall. Large storage bins are provided with a hook on each of the bin's side walls wherein each of the hooks has a pin engaging ramp edge positioned to engage only a forwardly positioned pin. Small storage bins are provided with a hook on each of the bin's side walls wherein each of the hooks has a first ramp edge for engaging a forwardly positioned pin and a second ramp edge for engaging a rearwardly positioned pin.

26 Claims, 3 Drawing Sheets

STORAGE BIN MOUNTING SYSTEM FOR A REFRIGERATOR AND METHOD OF ASSEMBLY

FIELD OF THE INVENTION

The present invention relates to a refrigerator and more particularly to a system, and method of assembling the system, for mounting storage bins on a door of the refrigerator to prevent interference between storage bins of a particular size and refrigerator members disposed opposite the storage bins in the refrigerator/-freezer compartments.

DESCRIPTION OF THE PRIOR ART

Known refrigerators include various systems for mounting shelves or storage bins on the doors of the refrigerator. One such system as shown in U.S. Pat. No. 2,718,446 mounts fixed sized shelves in fixed positions on a door of the refrigerator. Other systems for mounting adjustable shelves or storage bins in a refrigerator have employed a hook and slot arrangement such as shown in U.S. Pat. No. 3,212,836, U.S. Pat. No. 3,242,885 and U.S. Pat. No. 4,528,825 wherein hooks disposed at the rear of the shelf or bin engage slots disposed on a rear wall of a refrigerator compartment. This hook and slot arrangement has also been used to mount storage bins on a door of a refrigerator wherein the slots are disposed on the face of the refrigerator's door dikes. Although known hook and slot storage bin mounting systems are flexible, they do not provide any means to limit storage bins of a particular size to certain areas of the refrigerator where the storage bins will not interfere with other refrigerator members mounted opposite thereto.

SUMMARY OF THE INVENTION

In accordance with the present invention, the disadvantages of prior art refrigerator storage bin mounting systems have been overcome. The storage bin mounting system of the present invention includes a hook and pin arrangement that prevents large bins from being mounted on certain areas of a refrigerator door to prevent interference with other refrigerator members mounted in the refrigerator compartment opposite to those areas of the door. The hook and pin arrangement of the present invention, however, allows small bins to be mounted anywhere on the refrigerator door so as to provide flexibility.

The storage bin mounting system of the present invention includes pairs of vertically aligned, forwardly positioned pins, each pin of a pair extending inwardly from the side walls of opposite door dikes of a refrigerator door at a first distance from the door's rear wall. Pairs of vertically aligned, rearwardly positioned pins also extend from the door dikes at a distance from the rear wall of the door that is less than the first distance. Small storage bins are provided with a hook disposed at the rear of each of the bin's side walls wherein each of the small storage bin hooks has a first ramp edge for engaging a forwardly positioned pin and a second ramp edge for engaging a rearwardly positioned pin to secure the small bin to the refrigerator door by the engagement of the hooks with either a forwardly positioned pair of pins or a rearwardly positioned pair of pins.

Large storage bins are provided with a hook disposed at the rear of each of the bin's side walls wherein each of the large storage bin hooks has a pin engaging surface or ramp edge for engaging only a forwardly positioned pin. The pin engaging surface of each hook of the large storage bins is located at a distance from the rear of the large bin that is greater than the distance at which each of the rearwardly positioned pins is disposed relative to the rear wall of the refrigerator door so as to prevent the pin engaging surface of the large storage bin hooks from engaging a rearwardly positioned pin. The rearwardly positioned pins are aligned in a column on each of the door dikes in areas opposite large members, such as meat and vegetable storage bins, disposed in the refrigerator compartments so as to prevent large storage bins from being mounted on those areas of the door where they would interfere with the large members in the refrigerator compartment.

The pins of the mounting system of the present invention are formed having generally cylindrically shaped bodies that extend outwardly from a pin plate, each pin having a shoulder extending about its periphery near the pin plate. The pins may be grouped such that a plurality of spaced pins extends from a single pin plate for easy installation. To mount the pins to a door dike of the refrigerator, a group of pins on one plate are aligned with apertures formed in the side wall of the door dike. The pins are then forced through the apertures where they are retained by the pin shoulders.

Where the side walls of the door dikes are disposed at an angle such as 95° with respect to the rear wall of the door, the pins are formed such that the center line of each pin is at the same angle with respect to the pin plate so that when the pins are installed in the door dike, the center line of each of the pins is parallel to the rear wall of the door. A projection extending from one edge of the pin plate identifies the side of the pin plate relative to which the center lines of the pins have the same angle as the door dikes have with respect to the door's rear wall to aid in the installation of the pins in the proper orientation.

These and other objects, advantages and novel features of the present invention, as well as details of an illustrative embodiment thereof, will be more fully understood from the following description and the drawing.

DESCRIPTION OF THE PREFERRED EMBODIMENT

Figure 1:
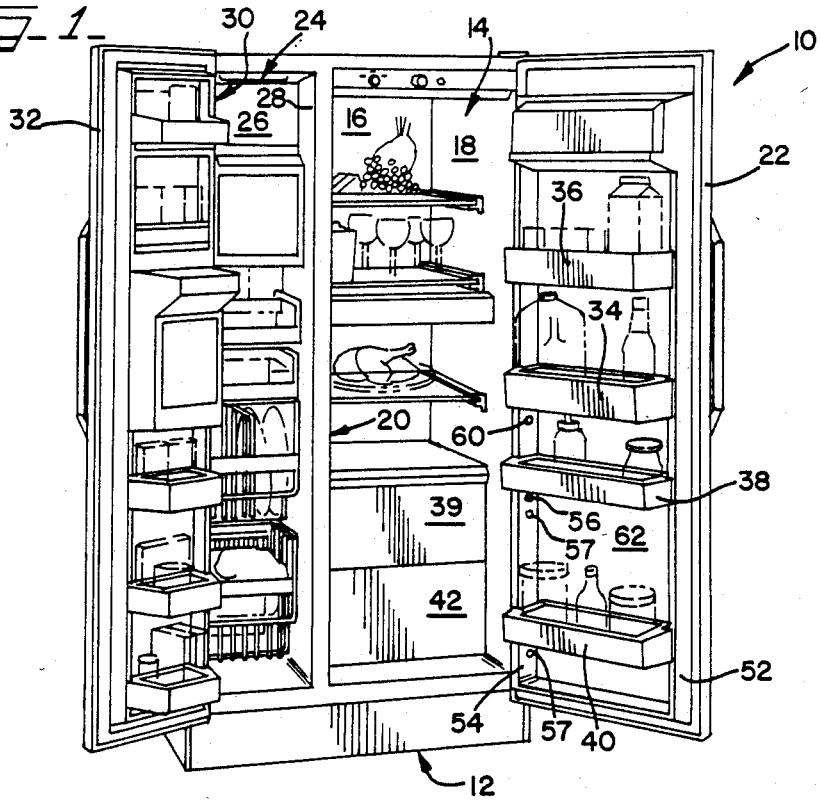
FIG. 1 is a perspective view of a side-by-side refrigerator constructed in accordance with the principles of the present invention.

A refrigerator 10, shown in FIG. 1 and constructed in accordance with the principles of the present invention, includes a refrigerator cabinet 12 having a refrigerator compartment 14 with a rear wall 16, side walls 18 and 20 and a door 22. The refrigerator cabinet 12 also includes a freezer compartment 24 with a rear wall 26, side walls 28 and 30 and a door 32. Storage bins are mounted on the refrigerator 10 with a pin and hook system shown in detail in FIGS. 2–6. The pin and hook storage bin mounting system prevents storage bins of a certain size from being mounted in certain areas of the refrigerator 10 to prevent interference between those storage bins and other refrigerator members mounted opposite to those areas.

Although FIGS. 2 and 4, described below, illustrate the pin and hook storage bin mounting system of the present invention for mounting storage bins on the refrigerator compartment door 22, the system may also be used to mount storage bins on the freezer compartment door 32 or to mount storage bins in the freezer and refrigerator compartments 14 and 24.

Figure 2:
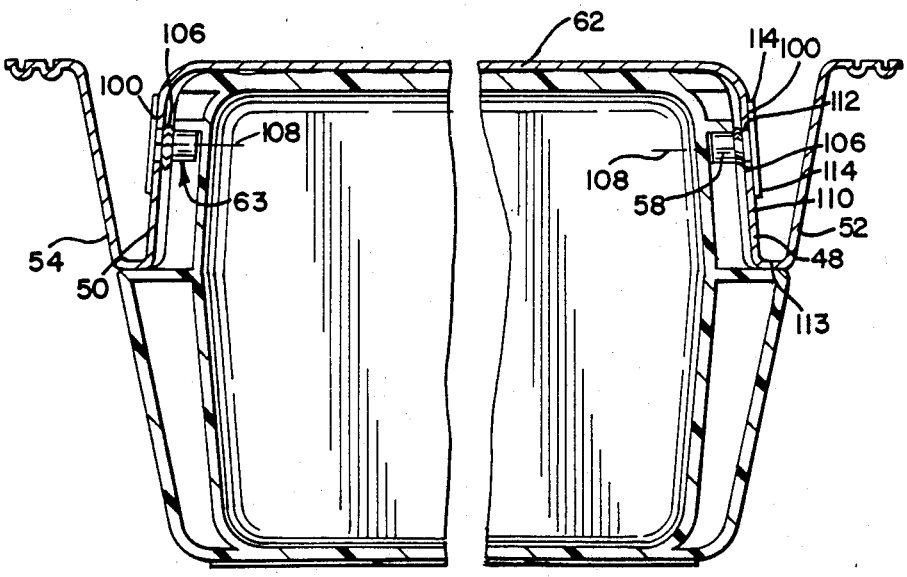
FIG. 2 is a top view of a pair of pin plates according to the present invention mounted in opposite door dikes shown with a storage bin in cross-section.
Figure 6:
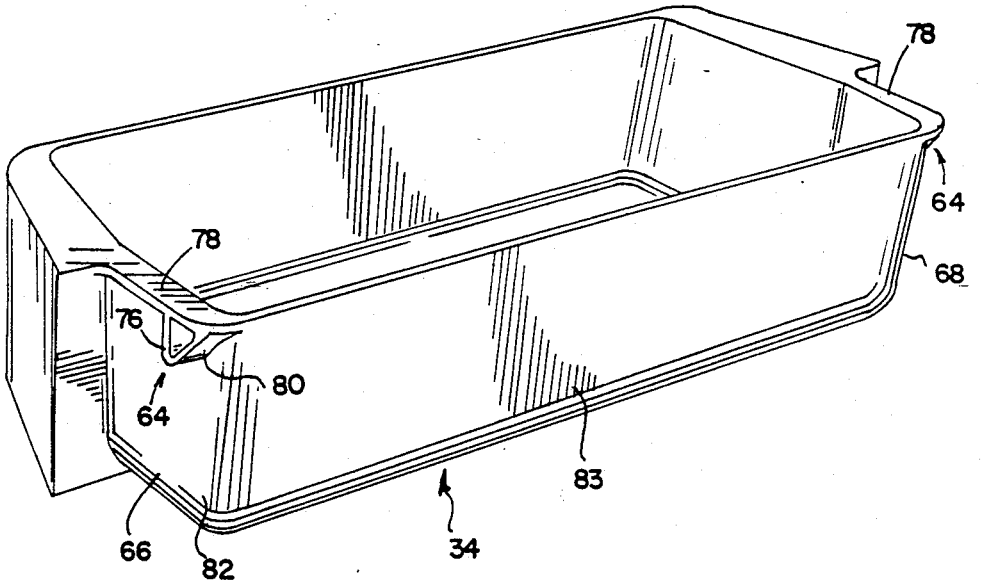
FIG. 6 is a perspective view of a large storage bin constructed in accordance with the principles of the present invention.

As shown in FIGS. 1 and 2, the refrigerator door 22 has door dikes 52 and 54 extending outwardly from a rear wall 62 of the door 22. Pairs of vertically aligned pins, such as the pins 58 and 63 extend inwardly from the inner side walls 48 and 50 of the respective door dikes 52 and 54 in either a rearward position depicted by pins 56 and 57 or a forward position depicted by pins 58–61, 65 and 67 shown in FIG. 4. In the forward position, the pins 58–61, 65 and 67 are spaced a distance from the rear wall 62 of the door 22 that is greater than the distance from the rear wall 62 to the rearwardly positioned pins 56, 57. Large bins as shown in FIGS. 4 and 6 for bin 34 have a hook 64 extending from each of the bin's side walls 66 and 68 at the rear thereof such that the hooks 64 can only engage the forwardly positioned pins 58–61, 65 and 67. Small bins 38 and 40, however, have a hook 70 extending from each of the bin's side walls 72 and 74 at the rear thereof such that the hooks 70 can engage either the rearwardly positioned pins 56, 57 or the forwardly positioned pins 58–61, 65 and 67.

Figure 4:
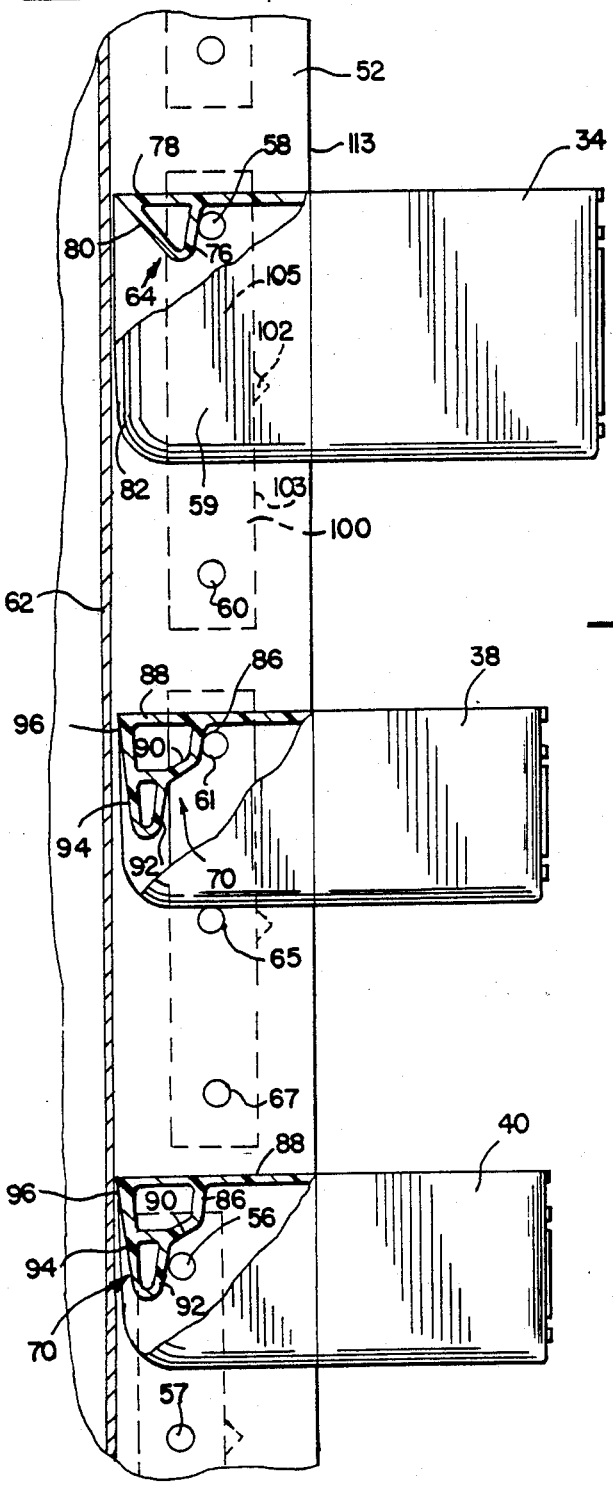
FIG. 4 is a front view of the inner side wall of a door dike illustrating the pin positions relative to the refrigerator door's rear wall for engagement with large and small storage bins.
Figure 3:
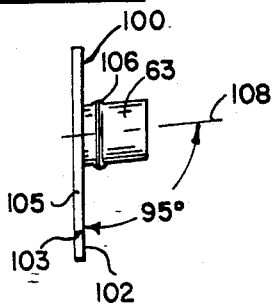
FIG. 3 is a top view of one of the pin plates shown in FIG. 2.
Figure 5:
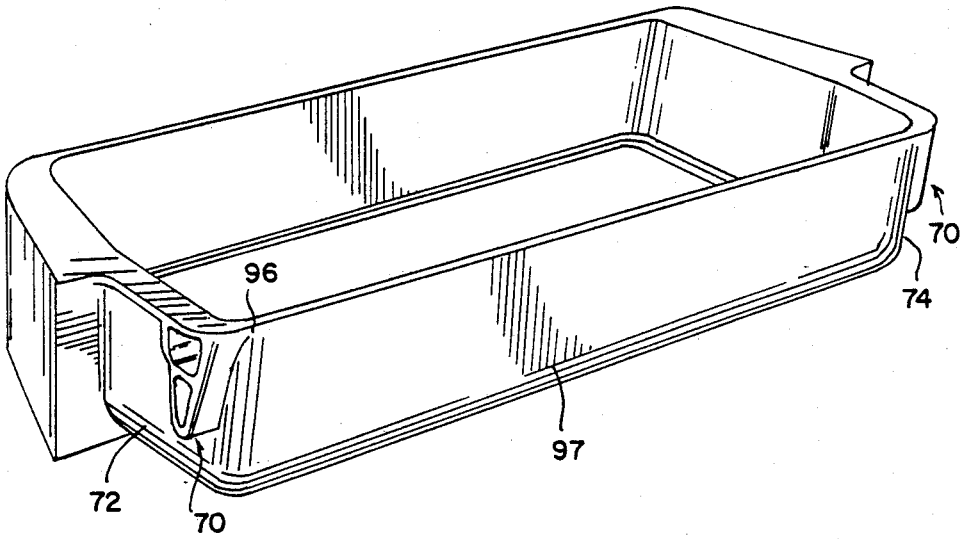
FIG. 5 is a perspective view of a small storage bin constructed in accordance with the principles of the present invention.

More particularly, each of the hooks 64 of the large bins 34 and 36, as shown for large bin 34 in FIGS. 4 and 6, has a pin engaging surface or ramp edge 76 that extends downwardly and slightly rearwardly from an upper edge 78 of the large bin's side wall 66, 68. The pin engaging ramp edge 76 extends into a rear ramp edge 80 that extends upwardly and rearwardly to the upper edge 78 of the large bin's side wall 66, 68. The distance of the pin engaging ramp edge 76 of each of the large bin's hooks 64 to the rear 82 of the bin's side walls 66, 68 and to the rear wall 83 of the large bin 34 is greater than the distance between the rearwardly positioned pins 56, 57 and the rear wall 62 of the refrigerator door 22 so as to prevent the hooks 64 of the large bin 34 from engaging a rearwardly positioned pin 56, 57. The distance of the pin engaging ramp edge 76 of each of the large bin's hooks 64 to the rear 82 of the bin's side walls 66, 68 and to the rear wall 83 of the large bin 34 is approximately equal to the distance between the forwardly positioned pins 58–61, 65 and 67 and the rear wall 62 of the door 22 to allow the hook 64 to be wedged between a forwardly positioned pin 58 and the rear wall 62 of the door 22. With the hook 64 wedged between a forwardly positioned pin 58 and the door's rear wall 62, the ramp edge 76 of the hook 64 engages the forwardly positioned pin 58 adjacent the upper edge 78 of the large bin 34 to secure the large bin 34 to the refrigerator door 22.

Each of the hooks 70 of the small bins 38 and 40 has a first ramp edge 86 that extends downwardly and slightly rearwardly from an upper edge 88 of the side wall 72, 74 of the small bin 38, 40. The first ramp edge 86 of the small bin hooks 70 extends generally downwardly into a connecting ramp edge 90 that extends rearwardly and slightly downwardly into a second ramp edge 92. The second ramp edge 92 extends into a rear ramp edge 94 that extends upwardly and slightly rearwardly to the upper edge 88 of the small bin's side wall 72, 74. The distance of the first ramp edge 86 of the small bin's hooks 70 to the rear 96 of the bin's side walls 72, 74 and to the rear wall 97 of the small bin is approximately equal to the distance between the forwardly positioned pins 58–61 and the rear wall 62 of the door 22 to allow the hook 70 to be wedged between a forwardly positioned pin 61 and the door's rear wall 62 with the first ramp edge 86 engaging the forwardly positioned pin 61 adjacent the upper edge 88 of the small bins 38 to secure the small bin 38 to the refrigerator door 22 as shown in FIG. 4. Further, the distance of the second ramp edge 92 of the small bin's hooks 70 is approximately equal to the distance between the rearwardly positioned pins 56, 57 and the rear wall 62 of the refrigerator door 22 to allow the hook 70 to be wedged between a rearwardly positioned pin 56 and the door's rear wall 62 with the second ramp edge 92 engaging the rearwardly positioned pin 56 approximately one-half of an inch below the upper edge 88 of the small bin 40 to secure the small bin 40 to the refrigerator door 22 as shown in FIG. 4.

The pins of the present invention are formed in groups extending outwardly from a pin plate 100 to aid in the installation of the pins on the door dikes 52 and 54. More particularly, as shown in FIG. 4, three pins, such as the pins 58–60 having generally cylindrically shaped bodies, extend outwardly from a single pin plate 100. The pins 58–60 and the pin plate 100 are integrally formed of molded plastic. Each of the pins, as shown in FIG. 1 for pins 58 and 63, is formed with a shoulder 106 extending around the periphery thereof at a distance from the pin plate 100 to accommodate the thickness of a side wall 48, 50 of the door dike 52, 54 onto which the pins are mounted. Further, each of the pins is formed having its center line at an angle slightly greater than 90° with respect to the pin plate 100 to account for the angle of the door dike's side wall 48, 50 with respect to the rear wall 62 of the refrigerator door 22. More particularly, since the door dike's side wall 48, 50 with respect to the rear wall 62 of the refrigerator door 22. More particularly, since the door dike's side walls 48, 50 are disposed at a 95° angle with respect to the rear wall 62 of the refrigerator door 22, the pins 58, 63 are formed such that their center lines 108 are at a 95° angle with respect to the pin plate 100 so that when the pins 58, 63 are installed in the door dikes 52, 54, the center line 108 of each of the pins 58, 63 is parallel to the rear wall 62 of the refrigerator door 22. A triangular projection 102 extending from the center of one edge 103 of the pin plate 100 identifies the side 105 of the pin plate 100 relative to which the center line 108 has a 95° angle to aid in installing the pin plate 100 in the proper orientation.

To install a set of pins 58–60 on the refrigerator door 22, the pin plate 100 is maneuvered adjacent the back side 110 of the side wall 48 of the door dike 52 and positioned such that the pins 58–60 are aligned with a set of apertures 112, only one of which is shown, disposed in the side wall 48 of the door dike 52 with the triangular projection 102 pointing toward the front face 113 of the door dike 52 so that the center line 108 of each of the pins 58–60 is parallel to the rear wall 62 of the door 22. After aligning the pins 58–60, the pins 58–60 are forced through the apertures 112 in the door dike's side wall 48. The pins are retained in the apertures 112 by their shoulders 106 with the pin plate 100 being held tight against various thicknesses of the door dike side wall 48 by spacers 114 disposed along the sides of the pin plate 100. The shoulders 106 not only retain the pins in position but also serve to center the storage bins 34, 38 and 40 between the opposite door dikes 52 and 54 since the shoulders 106 form a stop for the bins.

Although the large bins 34 and 36 and the small bins 38 and 40 have the same length which is approximately equal to the distance between the door dikes 52 and 54, the large bins 34 and 36 are deeper and wider than the small bins 38 and 40. Because the large bins 34, 36 are wider than the small bins 38, 40, when the refrigerator door 22 is closed, the large bins 34 and 36 mounted on the refrigerator door 22 extend a greater distance into the refrigerator compartment 14 than the distance that the small bins 38 and 40 mounted on the refrigerator door 22 extend into the refrigerator compartment 14. To prevent interference between the large bins 34, 36 mounted on the refrigerator door 22 and large storage containers such as meat and vegetable storage bins 39 and 42, mounted in the refrigerator compartment 14, the rearwardly positioned pins 56 and 57 are disposed in the refrigerator door dikes 52, 54 opposite the large meat and vegetable storage bins 39 and 42. Since the hooks 64 of the large bins 34 and 36 cannot engage the rearwardly positioned pins 56 and 57, the large bins 34 and 36 are prevented from being mounted on the refrigerator door 22 in a position that would interfere with the storage bins 39 and 42. The forwardly positioned pins 58–61, 65 and 67 are mounted generally in the upper portion of the refrigerator door 22 opposite that portion of the refrigerator compartment 14 in which no large storage containers are mounted.

The pin and hook arrangement of the present invention is aesthetically pleasing. The arrangement allows small storage bins to be adjustably mounted in any position on the refrigerator/freezer doors 22 and 32 while preventing large bins from being mounted in certain areas on the doors 22, 32 where they would interfere with large refrigerator members such as the large storage bins 39, 42 mounted in the refrigerator compartment 14. Further, the pins of the present invention are easily manufactured in groups on a pin plate and readily installed by snapping a group of pins onto a door dike of the refrigerator 10.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. In a refrigeration apparatus having a cabinet with a cabinet member having a rear wall and a pair of side members extending outwardly from opposite sides of said rear wall, a storage member mounting system comprising:

a first pair of vertically aligned first pins, each having generally cylindrically shaped bodies extending inwardly from opposite side members of said cabinet member at a given first distance from said rear wall of said cabinet member;

a second pair of vertically aligned second pins, each having generally cylindrically shaped bodies extending inwardly from opposite side members of said cabinet member at a given second distance from said rear wall of said cabinet member, said first distance being greater than said second distance;

a first storage member having opposed side walls with a first hook disposed on the outer surface of each of said side wall, each of said first hooks having a first pin engaging ramp surface extending generally downwardly from an upper edge of a respective side wall at a distance from the rear of said side wall that is approximately equal to said given first distance to allow said first hooks to be wedged between said first pins and the rear wall of said cabinet member while preventing said first hooks from being wedged between said second pins and the rear wall of said cabinet member;

a second storage member having opposed side walls with a second hook disposed on the outer surface of each of the side walls, each of said second hooks having a first pin engaging ramp surface and a serially disposed second pin engaging ramp surface extending generally downwardly from an upper edge of a respective side wall, said first pin engaging ramp surface being at a distance from the rear of said side wall that is approximately equal to said given first distance and said second pin engaging ramp surface being at a distance from the rear of said side wall that is approximately equal to said given second distance to enable said second hooks selectively to be wedged either between said first pins and the rear wall of said cabinet member or between said second pins and the rear wall of said cabinet member.

2. A refrigeration apparatus storage member mounting system as recited in claim 1 wherein each of said pins extends outwardly from a plate and the side members of said cabinet member include apertures through which the bodies of said pins extend.

3. A refrigeration apparatus storage member mounting system as recited in claim 2 wherein each of said pins has a shoulder extending about the periphery of the pin near said plate so as to retain the pin secured to the cabinet member's side member.

4. A refrigeration apparatus storage member mounting system as recited in claim 2 wherein a plurality of pins extend from one plate.

5. A refrigeration apparatus storage member mounting system as recited in claim 2 wherein the side member of said cabinet member extends at an angle with respect to the rear wall of said cabinet member and the center line of each of said pins extends at said same angle with respect to the plate so that the center line of the pins is parallel to the rear wall of the cabinet member when the pins are installed.

6. In a refrigeration apparatus having a cabinet with a cabinet member having a rear wall and pair of side members extending outwardly from opposite sides of said rear wall, a storage member mounting system comprising:

a first pair of vertically aligned, forwardly positioned pins, each of said forwardly positioned pins extending inwardly from opposite side members of said cabinet member at a first distance from the rear wall of said cabinet member;

a second pair of vertically aligned, rearwardly positioned pins, each of said rearwardly positioned pins extending inwardly from opposite side members of said cabinet member at a second distance from the rear wall of said cabinet member, said second distance being less than said first distance; and a first storage member having opposed side walls with a hook disposed on the outer surface of each of said side walls, each of said hooks having a first ramp edge for engaging a forwardly positioned pin and having a second ramp edge for engaging a rearwardly positioned pin to secure said first storage member to said cabinet member by the engagement of said hooks with either said forwardly positioned pins or said rearwardly positioned pins with said first storage member abutting said cabinet member.

7. A refrigeration apparatus storage member mounting system as recited in claim 6 further including a second storage member having opposed side walls with a hook disposed on the outer surface of each of said side walls, each of said hooks having a pin engaging surface for engaging only a forwardly positioned pin.

8. A refrigeration apparatus storage member mounting system as recited in claim 7 wherein the pin engaging surface of each hook of said second storage member is located at a distance from the rear of the second storage member's side wall that is greater than the second distance at which each of said rearwardly positioned pins is disposed relative to the rear wall of said cabinet member so as to prevent said pin engaging surface from engaging a rearwardly positioned pin.

9. A refrigeration apparatus storage member mounting system as recited in claim 7 wherein each hook of said second storage member has a pin engaging ramp edge extending generally downwardly from an upper edge of said second storage member's side wall to a rear ramp edge extending upwardly and rearwardly from said first pin engaging ramp edge to the upper edge of said second storage member's side wall.

10. A refrigeration apparatus storage member mounting system as recited in claim 6 wherein the first ramp edge of each hook of said first storage member extends generally downwardly from an upper edge of said first storage member's side wall to a connecting edge, said connecting edge extending generally rearwardly to said second ramp edge and said second ramp edge extending generally downwardly from said connecting edge.

11. A refrigeration apparatus storage member mounting system as recited in claim 6 wherein each of said pins has a generally cylindrical body extending outwardly from a plate and the side members of said cabinet member include apertures through which the bodies of said pins extend.

12. A refrigeration apparatus storage member mounting system as recited in claim 11 wherein each of said pins has a shoulder extending about the periphery of the pin near said plate so as to retain the pin secured to the cabinet member's side member.

13. A refrigeration apparatus storage member mounting system as recited in claim 11 wherein a plurality of pins extend from one plate.

14. A refrigeration apparatus storage member mounting system as recited in claim 11 wherein the side member of said cabinet member extends at an angle with respect to the rear wall of said cabinet member and the center line of each of said pins extends at said same angle with respect to the plate so that the center line of the pins is parallel to the rear wall of the cabinet member when the pins are installed.

15. A refrigeration apparatus storage member mounting system as recited in claim 14 wherein said plate has a projection extending from an edge thereof to aid in the installation of said pins in the proper orientation with respect to the rear wall of said cabinet member.

16. In a refrigeration apparatus having a door with a rear wall and a pair of door dikes extending outwardly from opposite sides of said rear wall, a storage bin mounting system comprising:

a first pair of vertically aligned, forwardly positioned pins, each of said forwardly positioned pins extending inwardly from opposite door dikes at a first distance from the rear wall of said door;

a second pair of vertically aligned, rearwardly positioned pins, each of said rearwardly positioned pins extending inwardly from opposite door dikes at a second distance from the rear wall of said door, said second distance being less than said first distance; and a first storage pin having opposed side walls with a hook disposed on the outer surface of each of said side walls, each of said hooks having a first ramp edge for engaging a forwardly positioned pin and having a second ramp edge for engaging a rearwardly positioned pin to secure said first storage bin to said door by the engagement of said hooks with either said forwardly positioned pins or said rearwardly positioned pins with the first storage bin abutting said door.

17. A refrigeration apparatus storage bin mounting system as recited in claim 16 further including a second storage bin having opposed side walls with a hook disposed on the outer surface of each of said side walls, each of said hooks having a pin engaging surface for engaging only a forwardly positioned pin.

18. A refrigeration apparatus storage bin mounting system as recited in claim 17 wherein the pin engaging surface of each hook of said second storage bin is located at a distance from the rear of the second storage bin's side wall that is greater than the second distance at which each of said rearwardly positioned pins is disposed relative to the rear wall of said door so as to prevent said pin engaging surface from engaging a rearwardly positioned pin.

19. A refrigeration apparatus storage bin mounting system as recited in claim 17 wherein each hook of said second storage bin has a pin engaging ramp edge extending generally downwardly from an upper edge of said second storage bin's side wall to a rear ramp edge that extends upwardly and rearwardly from said first pin engaging ramp edge to the upper edge of said second storage bin's side wall.

20. A refrigeration apparatus storage bin mounting system as recited in claim 16 wherein the first ramp edge of each hook of said first storage bin extends generally downwardly from an upper edge of said first storage bin's side wall to a connecting edge, said connecting edge extending generally rearwardly to said second ramp edge and said second ramp edge extending generally downwardly from said connecting edge.

21. A refrigeration apparatus storage bin mounting system as recited in claim 16 wherein each of said pins has a generally cylindrical body extending outwardly from a plate and the door dikes includes apertures through which the bodies of said pins extend.

22. A refrigeration apparatus storage bin mounting system as recited in claim 21 wherein each of said pins has a shoulder extending about the periphery of the pin near said plate so as to retain the pin secured to the door dikes.

23. A refrigeration apparatus storage bin mounting system as recited in claim 21 wherein a plurality of pins extend from one plate.

24. A refrigeration apparatus storage bin mounting system as recited in claim 21 wherein the door dikes extend at an angle with respect to the rear wall of said door and the center line of each of said pins extends at said same angle with respect to the plate so that the center line of the pins is parallel to the rear wall of the door when the pins are installed.

25. A refrigeration apparatus comprising a refrigeration compartment, refrigeration storage means disposed in said compartment, refrigerator door means for providing access to and for closing said compartment, a plurality of storage bins of at least a first and a second size and mounting means for selectively mounting said storage bins at various locations to said door means and for limiting the mounting of one or more of said first size bins to particular locations along said door vertically spaced from said storage means to prevent physical interference with said storage means in said compartment when said door means is closed, while enabling said second size bins to be mounted to said door horizontally spaced in relation with said storage means, wherein said door means includes a rear wall and said mounting means includes first and second sets of vertically aligned, spaced apart pairs of pins disposed on said door for operatively engaging one of said storage bins, said first set of pins being spaced from said rear wall by a first spacing greater than a second spacing from said rear wall of said second set of pins.

26. A refrigeration apparatus as recited in claim 25 wherein said mounting means further includes a first pair of vertically aligned spaced apart hooks formed on each one of said one or more bins of said first size and a second pair of vertically aligned, spaced apart hooks formed on each one of said one or more bins of said second size, said first pair of hooks being physically configured to securely engage only said first pair of pins and not said second pair of pins, said second pair of hooks being physically configured to securely engage selectively either said first pair of hooks of said second pair of hooks.

* * * * *